US005299923A

United States Patent [19]

Arbogast et al.

[11] Patent Number: 5,299,923

[45] Date of Patent: Apr. 5, 1994

[54] INTERNAL GEAR PUMP

[75] Inventors: Franz Arbogast; Peter Peiz, both of Heidenheim, Fed. Rep. of Germany

[73] Assignee: J. M. Voith GmbH, Heidenheim, Fed. Rep. of Germany

[21] Appl. No.: 993,351

[22] Filed: Dec. 18, 1992

[30] Foreign Application Priority Data

Dec. 26, 1991 [DE] Fed. Rep. of Germany ..... 4142799

[51] Int. Cl.[5] ..... F01C 1/10

[52] U.S. Cl. ..... 418/169; 418/171

[58] Field of Search ..... 418/166, 168, 169, 170, 418/171

[56] References Cited

U.S. PATENT DOCUMENTS 3,602,616 8/1971 Jung ..... 418/170

FOREIGN PATENT DOCUMENTS 4104397 9/1991 Fed. Rep. of Germany .

4120757 1/1992 Fed. Rep. of Germany .

*Primary Examiner*—Richard A. Bertsch
*Assistant Examiner*—Charles G. Freay
*Attorney, Agent, or Firm*—Baker & Daniels

[57] ABSTRACT

An internal gear pump having the following characteristics: an internal gear; a pinion which meshes with the internal gear and is mounted eccentrically with regard to the internal gear; a shaft supporting the pinion; a central ring-shaped housing part encompassing the internal gear and pinion and comprising a suction socket as well as a pressure socket; on both sides of the central housing part, a ring-shaped housing intermediate part each by which the shaft is supported; a cutout provided in each intermediate part and extending bow-shaped in peripheral direction; a web is provided which bridges the sole cutout; and the web is located at least approximately in that area of the pinion which diametrically opposes the pressure socket.

5 Claims, 3 Drawing Sheets

INTERNAL GEAR PUMP

BACKGROUND OF THE INVENTION

The invention concerns an internal gear pump having an internal gear; a pinion meshing with the internal gear and mounted eccentrically with regard to the internal gear; a shaft supporting the pinion; a central ring-shaped housing part encompassing the internal gear and pinion and containing a suction socket as well as a pressure socket; a ring-shaped housing intermediate part on each side of the central housing part, each in which the shaft is supported; and a cutout portion in each intermediate part, which extends bow-shaped in peripheral direction. A pump of this general type is known from DE 41 04 397 A1.

Internal gear pumps of this type are used in simplex design, i.e., as single pumps. Provided axially outside the ring-shaped housing intermediate parts, in such case, is a housing cover plate which endwise seals the interior of the housing. However, also two or several internal gear pumps can be combined by flanging them together equiaxially. The said cover plates are dispensable in such case between two adjacent pumps. Further, there are pumps where a so-called filler part with a pertaining filler part pin is arranged between pinion and ring gear, is essentially sickle-shaped and extends essentially across the last quadrant of the cavity between ring gear and pinion.

Of importance with such pumps is the output performance, and in particular, parameters such as pump volume, achievable pressures and efficiency. Of increasing importance is the noise performance. Ever greater significance is attached to it in the context of humanizing the workplace. Considerable success has been achieved in recent years in this regard. While the noise level with a specific, known design ranged in 1987 still at 78 JB(A), it measured 69 JB(A) in 1991. To accomplish this, the major design features were optimized. These concerned especially the internal gearing, plain bearings as well as the radial and axial compensation. However, a further reduction of the noise level has not been achievable with conventional measures, despite significant efforts. In certain cases it is even necessary to forego the utilization of high pressures, or expensive sound insulation measures must be taken.

The problem underlying the invention is to fashion an internal gear pump in such a way that the noise performance displays a distinct reduction beyond the results that have been achieved to date.

SUMMARY OF THE INVENTION

This problem is solved by the features of the present invention. Accordingly, a web is provided on at least one of the two intermediate parts—viewed in axial direction—which web bridges the respective cutout. This web is to extend at least approximately parallel to the direction of the medium flow issuing out of the pressure socket. Especially favorable is an arrangement of the web in an axial plane.

With this simple and inexpensive solution it is possible to considerably lower the noise level at maximum pressures, generally by 5 dB(A). This makes the pump usable also for applications where heretofore it was not usable due to the high noise burden.

The invention can be used with all conceivable styles of internal gear pumps, for instance pumps with or without filler parts, in simplex pumps and also multiple pumps.

BRIEF DESCRIPTION OF THE DRAWINGS

The invention is more fully explained with the aid of the drawings, which in detail show the following.

DETAILED DESCRIPTION OF THE PREFERRED EMBODIMENT

Figure 1:
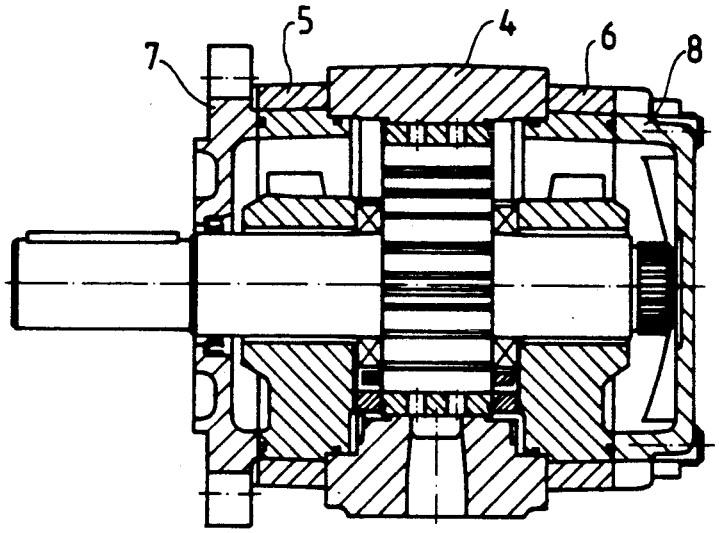
FIG. 1 shows an internal gear pump in a partial longitudinal section.

Referring now to the drawings, the internal gear pump features an internal gear 1, a meshing pinion 2, a shaft 3 supporting the pinion 2, a central housing part 4 being ring-shaped and encompassing the internal gear 1 and pinion 2, and axially, on both sides of the central housing part 4, housing intermediate parts 5 and 6. Located on both sides of the two intermediate parts are cover plates 7 and 8 sealing the housing interior endwise.

The housing features a suction socket 9 and a pressure socket 10. In the present case, the pressure socket 10 is directed perpendicularly downward. Located in the working space between the internal gear 1 and the pinion 2 is a filler part 20 with a filler part pin 21.

Figure 5:
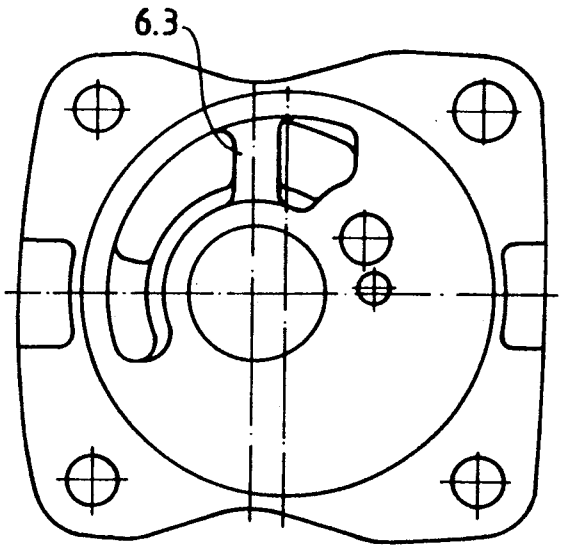
FIG. 5 shows a plan view of the intermediate part according to FIG. 3, in the viewing direction according to arrows V—V.
Figure 3:
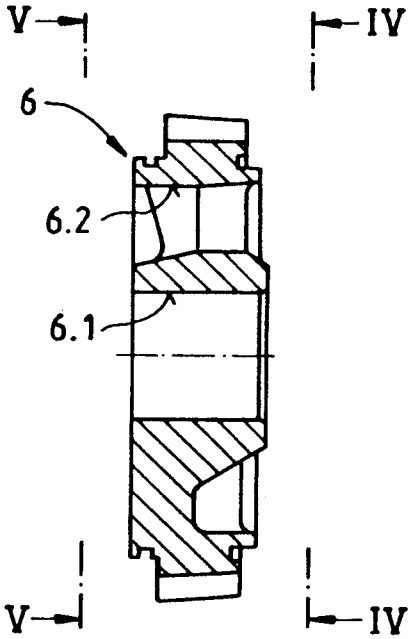
FIG. 3 shows a slightly scaled up view as compared to FIG. 1 and 2, of one of the two housing intermediate parts.
Figure 4:
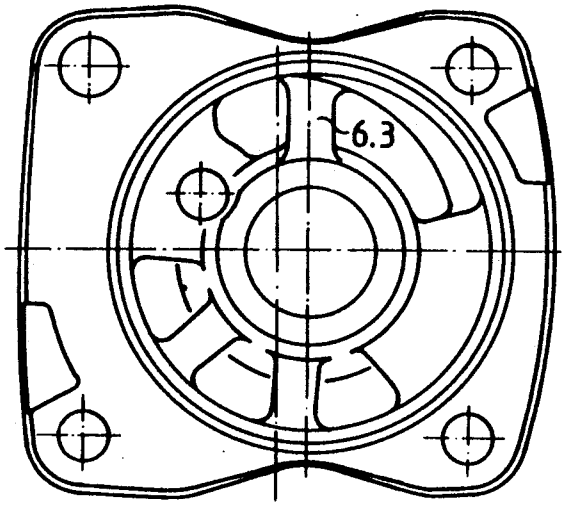
FIG. 4 shows a plan view of the intermediate part according to FIG. 3, in the viewing direction of arrow IV—IV.
Figure 6:
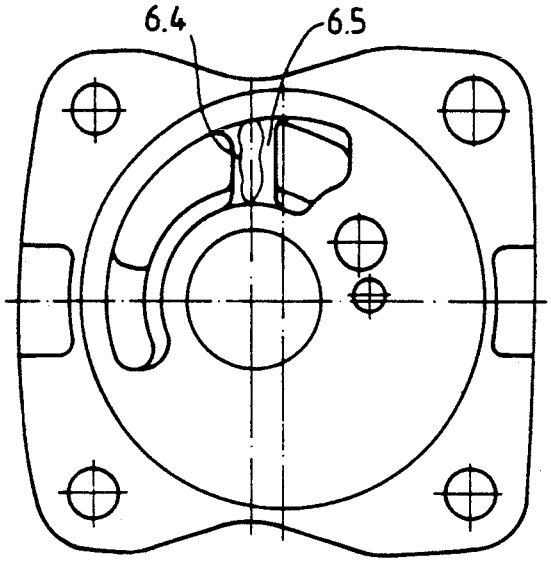
FIG. 6 shows a plan view of an alternative embodiment of the intermediate part shown in FIG. 5 which includes two webs.

Important features of the invention are shown in FIGS. 3 through 6. The illustrated housing intermediate part 5 features a bore 5.1 through which extends the shaft 3. This intermediate part—the same as the intermediate part 5—forms the bearing for the shaft 3. The intermediate part 6 features a cutout 6.2 extending bow-shaped across part of the circumference of the intermediate part, presently across about 130°. In FIG. 5 it can be seen that the cutout 6.2 extends on both sides of a perpendicular axial plane of the shaft 3. At any rate, the cutout 5.2—viewed in an axially perpendicular section—will extend beyond a plane in which the pressure socket 10 is situated.

Figure 2:
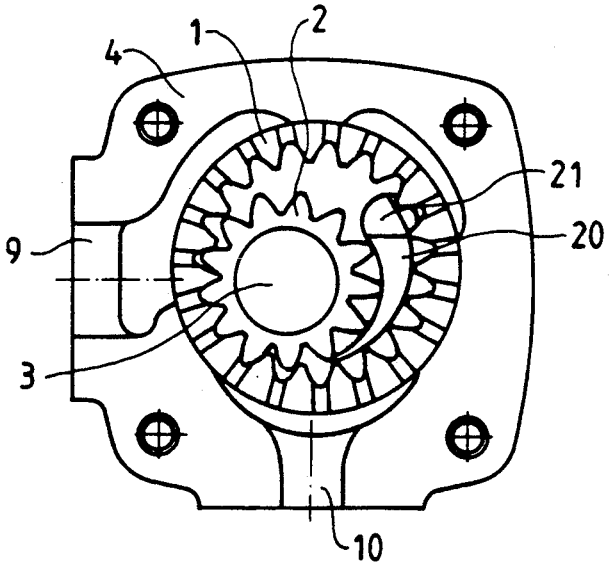
FIG. 2 shows a pump according to FIG. 1 in an axially perpendicular section.

Of particular importance is a web 6.3; it bridges the cutout 6.2. This web is in an axial plane—presently in a perpendicular axial plane. It extends thus parallel to the direction of the medium flow issuing from the pressure socket. Its shape is such that the medium flow, which is to pass through the cutout, will be minimally impaired. Hence, the web design may be favorable in terms of flow. Besides, the web needs to be only relatively thin. Moreover, it may be a fork, with two or more mutually parallel and still thinner individual webs 6.4 and 6.5 present. When combining several simplex pumps to multiple flow pumps, the end plates 7 and 8 visible in FIG. 1 and 2 are dispensable for those pumps bordering on adjacent pumps.

While this invention has been described as having a preferred design, the present invention can be further modified within the spirit and scope of this disclosure. This application is therefore intended to cover any variations, uses, or adaptations of the invention using its general principles. Further, this application is intended to cover any such departures from the present disclosure as come within known or customary practice in the art to which the invention pertains and which fall within the scope of the appended claims.

What is claimed is:

1. An internal gear pump, comprising:

an internal gear;

a pinion meshing with said internal gear and mounted eccentrically with regard to said gear;

a shaft supporting said pinion;

a central ring-shaped housing part encompassing the internal gear and pinion, said central housing part including a suction socket and a pressure socket;

respective ring-shaped housing intermediate parts axially disposed on each side of said central housing part for supporting said shaft;

a cutout portion in each of said intermediate parts, said cutout portion extending bow-shaped in peripheral direction; and a web disposed in at least one of said housing intermediate parts for bridging said cutout, said web being positioned at least partially in an area of said pinion diametrically opposite from said pressure socket.

2. The internal gear pump of claim 1, wherein a medium flows in said pressure socket, said web being positioned essentially parallel to the direction of the medium flow in the pressure socket.

3. The internal gear pump of claim 1, wherein the web is positioned in an axial plane of said shaft.

4. The internal gear pump of claim 1, including at least two webs.

5. Internal gear pump comprising:

an internal gear; a pinion meshing with the internal gear and mounted eccentrically with regard to the internal gear; a shaft supporting the pinion; a central ring-shaped housing part encompassing the internal gear and pinion, and containing a suction socket as well as a pressure socket; on both sides of the central housing part, a ring-shaped housing intermediate part each in which the shaft is supported; a cutout provided in each intermediate part and extending bow-shaped in peripheral direction; a web which bridges the single cutout, the web being located at least approximately in that area of the pinion which diametrically opposes the pressure socket.

* * * * *